US008851464B2

(12) United States Patent
Shimizu

(10) Patent No.: US 8,851,464 B2
(45) Date of Patent: Oct. 7, 2014

(54) SHEET POST-PROCESSING DEVICE FOLDING SHEET OUTPUT FROM IMAGE FORMING DEVICE, AND SHEET FOLDING METHOD

(71) Applicant: Konica Minolta, Inc., Tokyo (JP)

(72) Inventor: Satoru Shimizu, Toyohashi (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/645,161

(22) Filed: Oct. 4, 2012

(65) Prior Publication Data

US 2013/0087965 A1 Apr. 11, 2013

(30) Foreign Application Priority Data

Oct. 6, 2011 (JP) ..... 2011-221877

(51) Int. Cl.
*B65H 45/18* (2006.01)
*G03G 15/00* (2006.01)

(52) U.S. Cl.
CPC ..... *B65H 45/18* (2013.01); *B65H 2801/27* (2013.01); *G03G 15/6544* (2013.01)
USPC ..... 270/39.08; 270/32; 270/39.01; 270/39.06

(58) Field of Classification Search
USPC ..... 270/32, 37, 39.01, 39.06, 39.08, 45; 493/444, 445
See application file for complete search history.

(56) References Cited

U.S. PATENT DOCUMENTS 3,905,593 A * 9/1975 Behn ..... 493/17
6,526,256 B2 * 2/2003 Yoshie et al. ..... 399/407
7,040,612 B2 * 5/2006 Garner et al. ..... 270/8
7,077,393 B2 * 7/2006 Ishida ..... 270/37
7,077,798 B2 * 7/2006 Kawatsu et al. ..... 493/421
8,323,162 B2 * 12/2012 Decker et al. ..... 493/8
2004/0105713 A1 6/2004 Fukasawa et al.
2012/0035040 A1 * 2/2012 Decker et al. ..... 493/416

FOREIGN PATENT DOCUMENTS

JP 2003-341928 12/2003
JP 2004-277069 10/2004
JP 2007-76832 3/2007
JP 2007-297186 11/2007
JP 2008-037640 2/2008
JP 2010-137939 6/2010

OTHER PUBLICATIONS

Notification of Reasons for Refusal mailed Oct. 29, 2013, directed to JP Application No. 2011-221877; 5 pages.

* cited by examiner

*Primary Examiner* — Leslie A Nicholson, III
(74) *Attorney, Agent, or Firm* — Holtz, Holtz, Goodman & Chick PC

(57) ABSTRACT

Provided is a sheet post-processing device folding a sheet output from an image forming device at a predetermined target fold position, comprising: a first rotating body pair conveying the sheet; a second rotating body pair disposed along a sheet conveyance path and further downstream than the first rotating body pair in a sheet conveyance direction; a push unit moving a push member in a direction transverse to the sheet conveyance path so that, while the sheet is being conveyed, the push member comes into contact with the sheet and pushes the sheet into a nip of the second rotating body pair, the push member being disposed opposite the second rotating body pair across the sheet conveyance path; and a control unit controlling the push unit so that the pushing operation of the push member is performed at a timing preset according to the target fold position.

10 Claims, 8 Drawing Sheets

FIG. 2A When sheet is folded in two
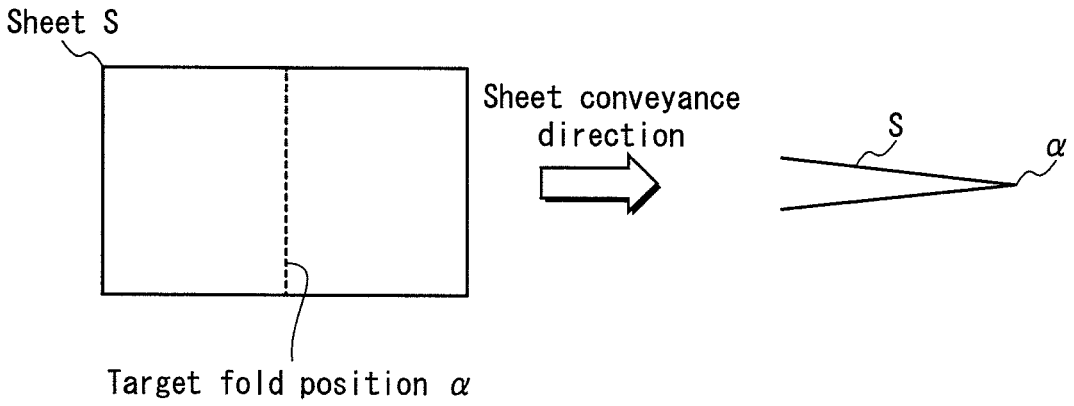
FIG. 2B When sheet is folded in three
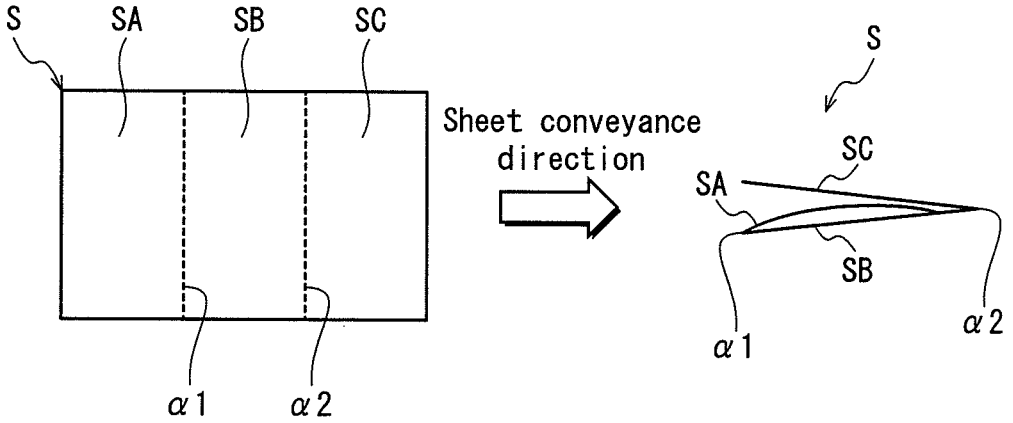

FIG. 5A At time t0
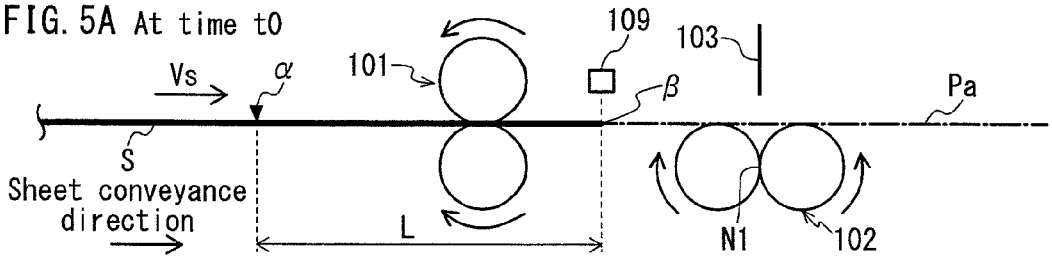
FIG. 5B At time t1
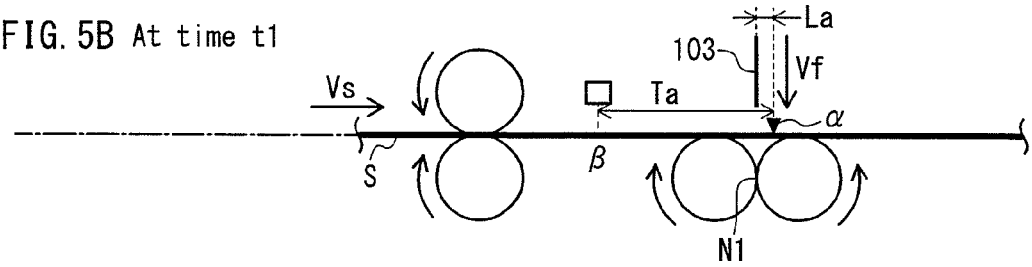
FIG. 5C At time t2
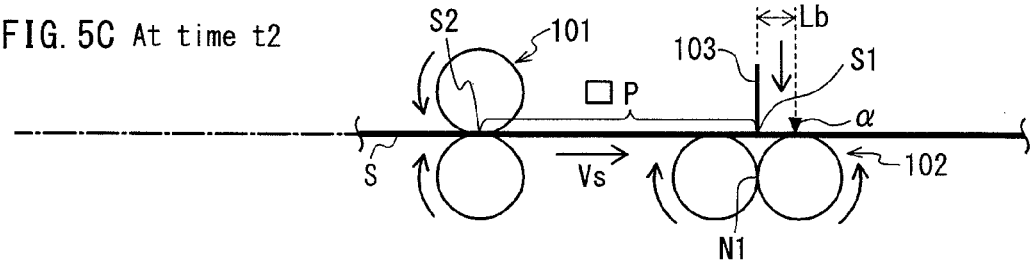
FIG. 5D At time t3
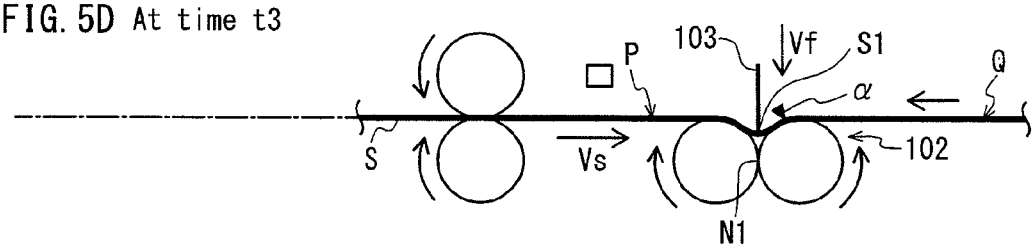
FIG. 5E At time t4
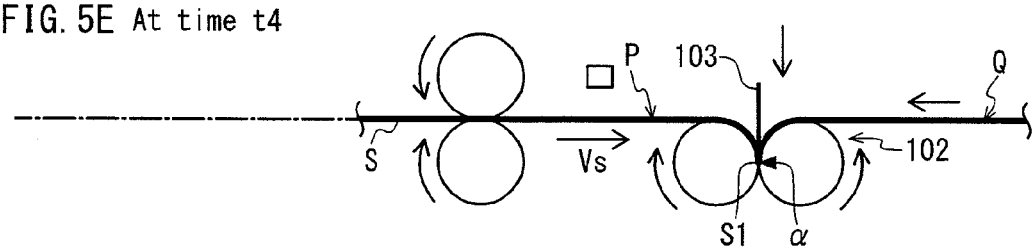
FIG. 5F At time t5
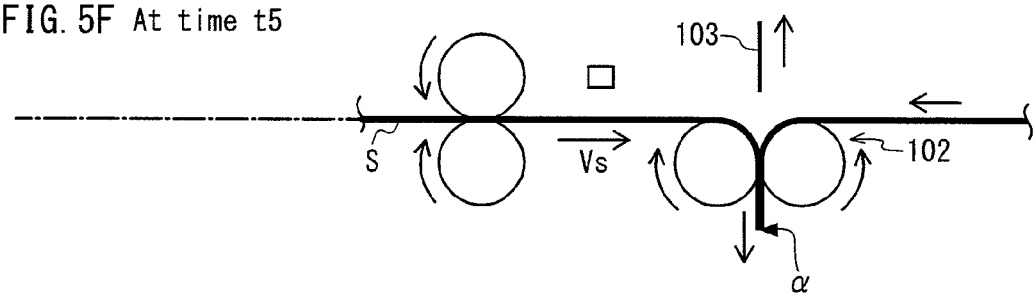

FIG. 7

55

| Sheet size | Drive start timing |
|---|---|
| A3 | T1 |
| B4 | T2 |
| A4 | T3 |
| B5 | T4 |

SHEET POST-PROCESSING DEVICE FOLDING SHEET OUTPUT FROM IMAGE FORMING DEVICE, AND SHEET FOLDING METHOD

This application is based on an application No. 2011-221877 filed in Japan, the contents of which are hereby incorporated by reference.

BACKGROUND OF THE INVENTION (1) Field of the Invention

The present invention relates to a sheet post-processing device folding a sheet output from an image forming device, and a sheet folding method.

(2) Related Art

A sheet post-processing device having a sheet folding function to fold a printed sheet output from an image forming device, such as a printer, by a job performed by the image forming device has been developed. For example, the printed sheet is folded in two by being folded in the middle thereof in a sheet conveyance direction, and is folded in three by being folded at two different positions in the sheet conveyance direction.

An example of such a sheet post-processing device is a sheet post-processing device including a folding roller pair disposed along a sheet conveyance path that slopes downward, a knife-shaped push plate disposed opposite the folding roller pair across the conveyance path, and a stopper disposed at a lower end portion of the conveyance path and is movable along the conveyance path.

At the time of folding a sheet, for each sheet size, the stopper is moved so that the sheet faces an edge of the push plate at a target fold position on the sheet in a state where the sheet is stopped with a lower edge thereof being in contact with the stopper. The push plate is then moved to perform a pushing operation to push the sheet into a nip of the folding roller pair at the target fold position on the sheet in a state where the edge of the push plate is in contact with the sheet at the target fold position on the sheet.

A sheet post-processing device including a movable stopper as described above, however, adds to the complexity and cost of the device.

Such problems arise not only when the device has a configuration in which a sheet to be used is selected from among sheets having different sizes, but also when the device has a configuration in which, for each sheet having the same size, whether to fold the sheet in two or in three, which differ in a fold position, is switched.

SUMMARY OF THE INVENTION

The present invention aims to provide a sheet post-processing device folding a sheet at a target fold position on the sheet without a stopper, and a sheet folding method.

The above-mentioned aim is achieved by a sheet post-processing device that folds a sheet output from an image forming device at a predetermined target fold position, comprising: a first rotating body pair configured to convey the sheet; a second rotating body pair disposed along a sheet conveyance path and further downstream than the first rotating body pair in a sheet conveyance direction; a push unit configured to move a push member in a direction transverse to the sheet conveyance path so that, while the sheet is being conveyed, the push member comes into contact with the sheet and pushes the sheet into a nip of the second rotating body pair, the push member being disposed opposite the second rotating body pair across the sheet conveyance path; and a control unit configured to control the push unit so that the pushing operation of the push member is performed at a timing preset according to the target fold position.

The above-mentioned aim is also achieved by a sheet folding method for use in a sheet post-processing device that folds a sheet output from an image forming device at a predetermined target fold position, the sheet folding method comprising: a first step of conveying the sheet using a first rotating body pair; and a second step of moving a push member in a direction transverse to a sheet conveyance path so that, while the sheet is being conveyed, the push member comes into contact with the sheet and pushes the sheet into a nip of a second rotating body pair at a timing preset according to the target fold position, the second rotating body pair being disposed along the sheet conveyance path and further downstream than the first rotating body pair in a sheet conveyance direction, the push member being disposed opposite the second rotating body pair across the sheet conveyance path.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIGS. 2A and 2B each schematically illustrate a sheet before and after being folded by a sheet folding function;

FIGS. 5A through 5F are schematic diagrams for explaining control over a sheet pushing operation;

FIG. 7 shows an example of a push plate drive timing table; and

DESCRIPTION OF PREFERRED EMBODIMENT

The following describes an embodiment of a sheet post-processing device and a sheet folding method according to the present invention, with reference to the drawings.

(1) Overall Configuration

Figure 1:
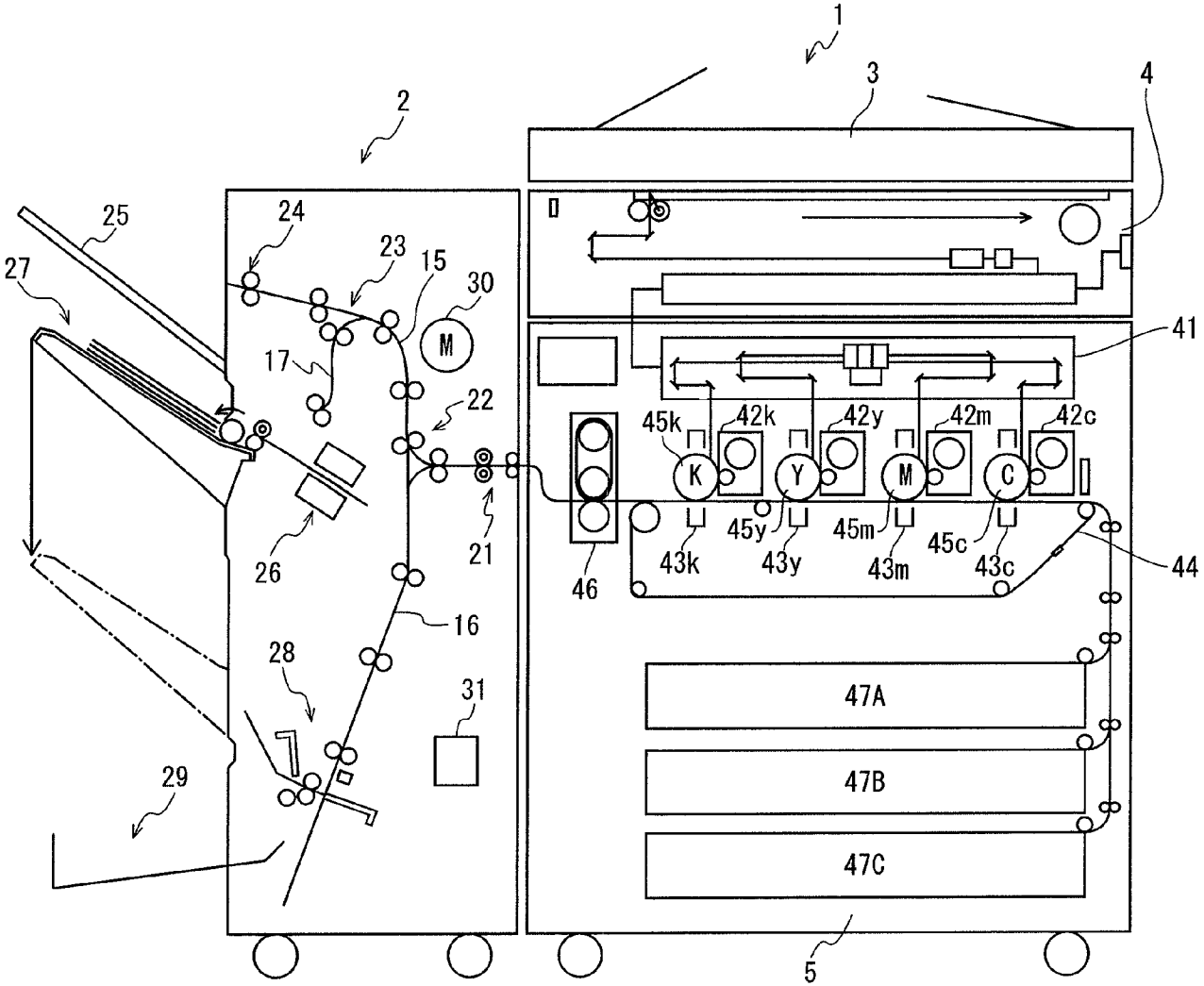
FIG. 1 illustrates a configuration of an image forming device and a sheet post-processing device.

FIG. 1 illustrates a configuration of an image forming device 1 and a sheet post-processing device 2.

As illustrated in FIG. 1, the image forming device 1 includes an automatic document feeder 3, a scanner 4, and a printer 5. The image forming device 1 is a multiple function peripheral (MFP) into which a plurality of functions such as a scanning function to scan a document placed on a document table to generate image data, a printing function to print an image based on the image data, and a copying function to scan and print a document are combined.

The automatic document feeder 3 automatically feeds a plurality of documents placed on a document tray by a user one by one to a scanning position where the scanner 4 scans each document.

The scanner 4 scans each document fed by the automatic document feeder 3 or placed on the document table by a user to generate image data.

The printer 5 forms an image on a recording sheet based on the generated image data, and outputs the sheet. The printer 5 includes an exposing unit 41, developing units 42*k*, 42*y*, 42*m*, and 42*c*, transfer chargers 43*k*, 43*y*, 43*m*, and 43*c*, a conveyance belt 44, a photosensitive drums 45*k*, 45*y*, 45*m*, and 45*c*, a fixing unit 46, and feed cassettes 47A, 47B, and 47C. In respective feed cassettes, sheets of different sizes can be set.

An image forming unit including, as its main components, components having reference signs to which a letter "k" is added generates an image by using black toner. Similarly, an image forming unit including, as its main components, components having reference signs to which a letter "y" is added, an image forming unit including, as its main components, components having reference signs to which a letter "m" is added, and an image forming unit including, as its main components, components having reference signs to which a letter "c" is added generate images by using yellow toner, magenta toner, and cyan toner, respectively.

In a printing operation, under the control of a control unit (not illustrated), electrostatic latent images are formed on the respective photosensitive drums 45*k*, 45*y*, 45*m*, and 45*c* by the exposing unit 41, and the electrostatic latent images are then developed by the respective developing units 42*k*, 42*y*, 42*m*, and 42*c* to form toner images of respective colors.

In parallel with the operation to form toner images of respective colors, a sheet is fed from one of the feed cassettes 47A, 47B, and 47C. When the fed sheet passes under the photosensitive drums 45*c*, 45*m*, 45*y*, and 45*k* in this order in a state where the sheet electrostatically adheres to the conveyance belt 44 that revolves at a constant speed, the toner images formed on the respective photosensitive drums 45*c*, 45*m*, 45*y*, and 45*k* are transferred sequentially onto the sheet by electrostatic interaction of the transfer chargers 43*c*, 43*m*, 43*y*, and 43*k*. The toner images of respective colors have been formed at different timings so that the toner images of respective colors overlap one another on the sheet when being transferred onto the sheet.

The toner images of respective colors transferred onto the sheet are fixed to the sheet by heat and pressure when the sheet passes through the fixing unit 46. The sheet passing through the fixing unit 46 is ejected (output) from the image forming device 1 and sent to the sheet post-processing device 2.

The sheet post-processing device 2 includes a sheet carrying unit 21, conveyance path switching units 22 and 23, a sheet ejecting unit 24, an ejection tray 25, a binding unit 26, a loading tray unit 27, a sheet folding unit 28, a post-processing tray 29, a conveyance motor 30, and a control unit 31. The sheet post-processing device 2 has a post-processing function including a stapling function to staple sheets output from the image forming device 1 and a sheet folding function to fold a sheet output from the image forming device 1 in two or in three.

FIG. 2A schematically illustrates a sheet before and after being folded in two by the sheet folding function, and FIG. 2B schematically illustrates a sheet before and after being folded in three by the sheet folding function.

As illustrated in FIG. 2A, when a sheet S is folded in two, a position where the sheet S is bisected in a sheet conveyance direction is set as a target fold position α. As illustrated in FIG. 2B, when the sheet S is folded in three, positions where the sheet S is approximately trisected in the sheet conveyance direction are set as target fold positions α1 and α2, and the sheet S is first folded at the position α1 and then folded at the position α2 so that a portion SA is folded inward to be sandwiched between a portion SB and a portion SC. The sheet is folded approximately in thirds in the above-mentioned manner. Since the portion SA is folded inward to be sandwiched between the portion SB and the portion SC, the portion SA is slightly smaller than the portion SB in width.

Referring back to FIG. 1, the sheet carrying unit 21 receives and carries a sheet output from the image forming device 1.

The conveyance path switching unit 22 switches a conveyance path to which the sheet carried from the sheet receiving unit 21 is conveyed between conveyance paths 15 and 16, according to an instruction from the control unit 31. The conveyance path is switched to the conveyance path 15 when the post-processing function is not performed or when the stapling function is performed, and is switched to the conveyance path 16 when the sheet folding function is performed.

The conveyance path switching unit 23 sends the sheet conveyed along the conveyance path 15 to the sheet ejecting unit 24 when the post-processing function is not performed, and guides the sheet conveyed along the conveyance path 15 to a branch path 17 when the stapling function is performed, according to an instruction from the control unit 31. The sheet guided to the branch path 17 is conveyed to the binding unit 26.

The sheet ejecting unit 24 ejects a sheet conveyed along the conveyance path 15 outside the device and houses the ejected sheet in the ejection tray 25.

The binding unit 26 receives sheets conveyed along the branch path 17 one by one and houses the received sheets in a binding tray. When an appropriate number of sheets to be stapled are loaded on the binding tray, the binding unit 26 staples the stack of sheets and sends the stapled stack of sheets to the loading tray unit 27.

The loading tray unit 27 houses therein the stapled stack of sheets. In the present embodiment, the loading tray unit 27 is configured to move downward as the amount of housed stacks of sheets increases so that the loading tray unit 27 can house therein a large amount of stacks of sheets.

The sheet folding unit 28 folds a sheet conveyed along the conveyance path 16 in two or in three when performing the sheet folding function, and then houses the sheet in the post-processing tray 29.

The conveyance motor 30 drives to rotate each conveyance roller pair disposed on the conveyance paths 15, 16, and the like within the sheet post-processing device 2.

The control unit 31 controls components such as the sheet carrying unit 21 through the conveyance motor 30 so that the post-processing is performed smoothly on a sheet.

(2) Configuration of Sheet Folding Unit 28

Figure 3:
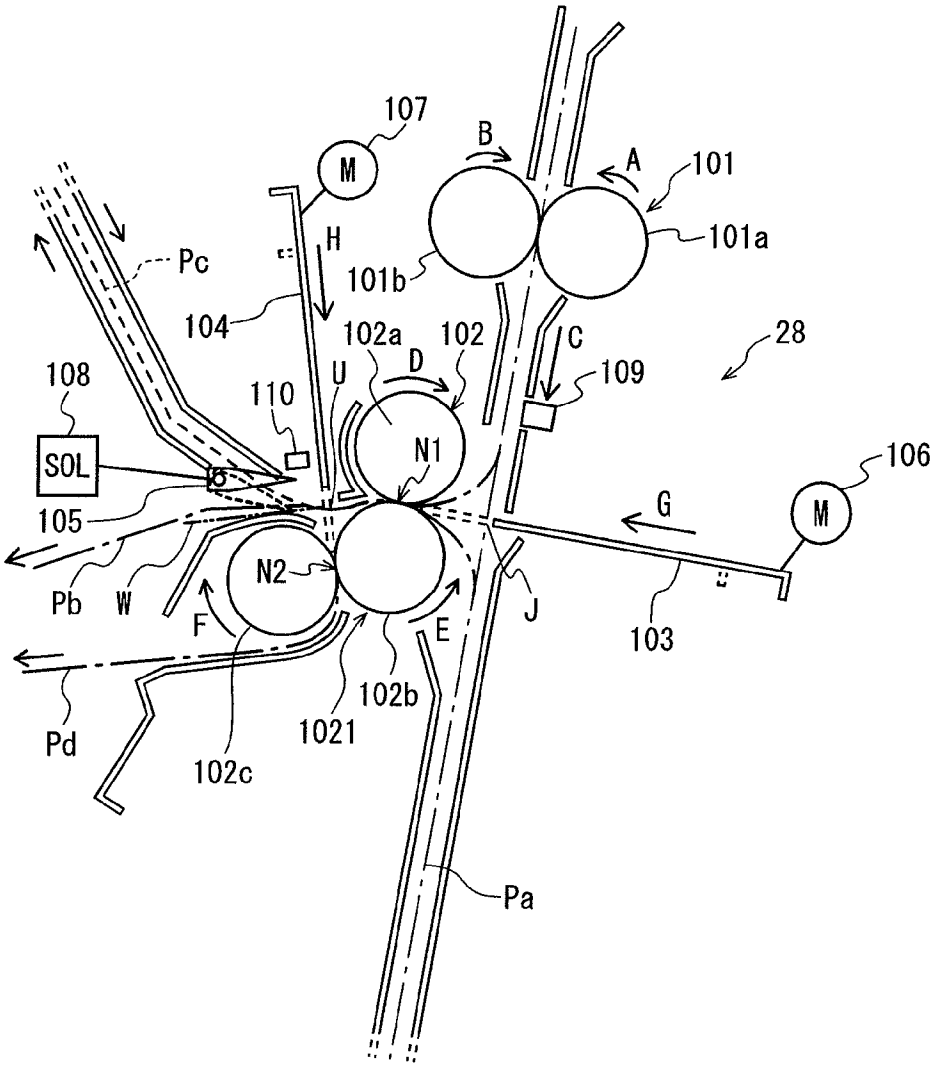
FIG. 3 is an enlarged view showing a configuration of a sheet folding unit included in the sheet post-processing device.

FIG. 3 is an enlarged view showing a configuration of the sheet folding unit 28.

As illustrated in FIG. 3, the sheet folding unit 28 includes a conveyance roller pair 101, folding rollers 102*a*, 102*b*, and 102*c*, push plates 103 and 104, a conveyance path switching member 105, push plate drive motors 106 and 107, a switching member drive actuator 108, and sheet edge detection sensors 109 and 110.

The conveyance roller pair (first rotating body pair) 101 is composed of two conveyance rollers 101*a* and 101*b* being in contact with each other. The conveyance rollers 101*a* and 101*b* are respectively rotated in a direction indicated by an arrow A and in a direction indicated by an arrow B by a drive force of the conveyance motor 30 to convey a sheet on a conveyance path Pa (an end portion of the conveyance path 16) in a direction indicated by an arrow C.

The folding rollers 102*a* and 102*b* are a roller pair used to fold a sheet in two or in three. The folding rollers 102*a* and

102*b* are each disposed along the conveyance path Pa and further downstream than the conveyance roller pair 101 in the sheet conveyance direction. The folding rollers 102*a* and 102*b* are in contact with each other, and a nip N1 is formed at a position where they are in contact with each other. The folding rollers 102*a* and 102*b* are respectively rotated in a direction indicated by an arrow D and in a direction indicated by an arrow E. The folding rollers 102*a* and 102*b* are rotated by a drive force of the conveyance motor 30, but may be driven by another motor (not illustrated).

The folding roller 102*c* is paired with the folding roller 102*b* and used only when a sheet is folded in three. The folding roller 102*c* is in contact with the folding roller 102*b* and a nip N2 is formed at a position where they are in contact with each other. The folding roller 102*c* is rotated in a direction indicated by an arrow F.

The folding rollers 102*a*, 102*b*, and 102*c* each have an elastic layer formed of rubber and the like. Adjacent two of the folding rollers 102*a*, 102*b*, and 102*c* are pressed against each other at pressure required to fold a sheet. The folding rollers 102*a*, 102*b*, and 102*c* are of approximately equal length in an axial direction thereof. Hereinafter, the folding rollers 102*a* and 102*b* are collectively referred to as a folding roller pair (second rotating body pair) 102, and the folding rollers 102*b* and 102*c* are collectively referred to as a folding roller pair 1021.

In the present embodiment, the folding roller pairs 102 and 1021 each convey a sheet at the same speed as a speed at which the conveyance roller pair 101 conveys a sheet. For example, however, a downstream roller pair disposed along the conveyance path may convey a sheet at a speed (circumferential speed) slightly faster than a speed at which an upstream roller pair disposed along the conveyance path conveys a sheet.

The push plate 103 is moved toward the nip N1 of the folding roller pair 102 so that, while a sheet is conveyed along the conveyance path Pa, the push plate 103 comes into contact with the sheet at an edge thereof and pushes the sheet into the nip N1 of the folding roller pair 102 at a target fold position on the sheet (the position α when the sheet is folded in two, and the position α1 when the sheet is folded in three (see FIGS. 2A and 2B)).

The push plate 103 is disposed opposite the folding roller pair 102 across the conveyance path Pa. The push plate 103 is elongated in an axial direction of the folding roller 102*a* so that, in an axial direction of the folding roller 102*a*, the length of the push plate 103 is approximately equal to the length of the folding roller 102*a*. The push plate 103 is supported by a device enclosure (not illustrated) so as to be movable along a direction transverse to the conveyance path Pa. In the present embodiment, the push plate 103 is movable along a direction indicated by an arrow G, which is a direction perpendicular to the conveyance path Pa.

The push plate 103 is moved, by a drive force of the push plate drive motor 106, from a standby position spaced apart from the conveyance path Pa (a position shown by a solid line) to a position of the nip N1 of the folding roller pair 102 (a position shown by a dashed line) with an edge thereof passing across the conveyance path Pa, and then is returned to the standby position. In this sense, the push plate 103 and the push plate drive motor 106 serve as a push unit performing a sheet pushing operation.

The sheet that is pushed into the nip N1 of the folding roller pair 102 at the target fold position α or α1 by the pushing operation of the push plate 103 is drawn into the nip N1 first at the target fold position α or α1, and folded by pressure of the folding roller pair 102 when passing through the nip N1 so that a fold is formed on the sheet.

The sheet folded by the folding roller pair 102 is conveyed along a conveyance path Pb and reaches the conveyance path switching member 105.

The conveyance path switching member 105 switches a conveyance path to which the sheet folded by the folding roller pair 102 is conveyed between a conveyance path for a sheet folded in two and a conveyance path for a sheet to be folded in three. Specifically, the sheet folded in two is conveyed to the conveyance path Pb in a position shown by a solid line, and the sheet to be folded in three is conveyed to a conveyance path Pc in a position shown by a dashed line. The position of the conveyance path switching member 105 is changed by a drive force of the switching member drive actuator 108. The switching member drive actuator 108 includes, for example, a solenoid.

When the sheet is folded in two, the folded sheet conveyed along the conveyance path Pb is ejected and housed in the post-processing tray 29 (FIG. 1).

When the sheet is folded in three, the push plate 104 is moved toward a nip N2 of the folding roller pair 1021 so that, while the sheet folded by the folding roller pair 102 is conveyed along the conveyance path Pc, the push plate 104 comes into contact with the sheet at an edge thereof and pushes the sheet into the nip N2 of the folding roller pair 1021 at the target fold position α2 (FIG. 2B) on the sheet.

When a sheet is folded in three, the folding roller pair 102 serves as the first rotating body pair conveying the sheet, and the folding roller pair 1021 serves as the second rotating body pair folding the sheet.

The push plate 104 is disposed opposite the folding roller pair 1021 across the conveyance path Pb. The push plate 104 is elongated in an axial direction of the folding roller 102*c* so that, in an axial direction of the folding roller 102*c*, the length of the push plate 104 is approximately equal to the length of the folding roller 102*c*. The push plate 104 is supported by the device enclosure so as to be movable along a direction transverse to the conveyance path Pb. In the present embodiment, the push plate 104 is movable along a direction indicated by an arrow H, which is a direction perpendicular to the conveyance path Pb.

The push plate 104 is moved, by a drive force of the push plate drive motor 107, from a standby position spaced apart from the conveyance path Pb (a position shown by a solid line) to a position of the nip N2 of the folding roller pair 1021 (a position shown by a dashed line) with an edge thereof passing across the conveyance path Pb, and then is returned to the standby position. In this sense, the push plate 104 and the push plate drive motor 107 serve as a push unit performing a sheet pushing operation.

The sheet that is pushed into the nip N2 of the folding roller pair 1021 at the target fold position α2 by the pushing operation performed by the push plate 104 is drawn into the nip N2 first at the target fold position α2, and folded by pressure of the folding roller pair 1021 when passing through the nip N2. The folded sheet is conveyed along a conveyance path Pd, and ejected and housed in the post-processing tray 29.

The pushing operation is performed by the push plate 104 in a state where a front edge portion of the sheet in the conveyance direction is conveyed along the conveyance path Pc. The conveyance path Pc includes a path part that is located further downstream, in the conveyance direction, than a position U where the conveyance path Pc and a track of movement of the push plate 104 cross, and extends away from an imaginary plane W in a direction opposite to a direction H in which the push plate 104 is moved as it extends downstream in the conveyance direction. Note that the imaginary plane W is perpendicular to the direction H in which the push plate 104 is moved and passes through the position U. That is to say, the conveyance path Pc includes a path part that slopes upward in a left-hand direction in FIG. 3.

With such a sloping path part being included, when a sheet is pushed into the nip N2 of the folding roller pair 1021 and folded into a V-shape with the edge of the push plate 104 being in contact with the sheet at the fold position, a front edge portion of the sheet in the conveyance direction (a portion of the sheet on the side of the portions SA and SB) extends along the conveyance path Pc.

If the sloping path part is not included (if the sheet is conveyed along the conveyance path Pb), swing of a sheet can be caused when the front edge portion of the sheet in the conveyance direction springs from a position along the conveyance path Pb to a position along the conveyance path Pc during a folding operation. The sloping path part suppresses such swing. In particular, a sheet folding operation is performed smoothly with respect to a sheet having been folded at a position in the front edge portion thereof in the conveyance direction.

The sheet edge detection sensor 109 is disposed along the conveyance path Pa and further downstream than the conveyance roller pair 101 in the sheet conveyance direction. The sheet edge detection sensor 109 detects a front edge of a sheet being conveyed along the conveyance path Pa and sends a detection signal to the control unit 31.

The sheet edge detection sensor 110 is disposed further downstream than the folding roller pair 102 in the sheet conveyance direction. The sheet edge detection sensor 110 detects a front edge of a sheet being conveyed along the conveyance path Pb (a sheet having been folded by the folding roller pair 102) and sends a detection signal to the control unit 31.

For example, reflective optical sensors are used as the sheet edge detection sensors 109 and 110. The sheet edge detection sensors 109 and 110, however, are not limited to optical sensors as long as they are configured to detect a front edge of a sheet being conveyed. Other types of sensors may be used as the sheet edge detection sensors 109 and 110.

(3) Configuration of Control Unit 31

Figure 4:
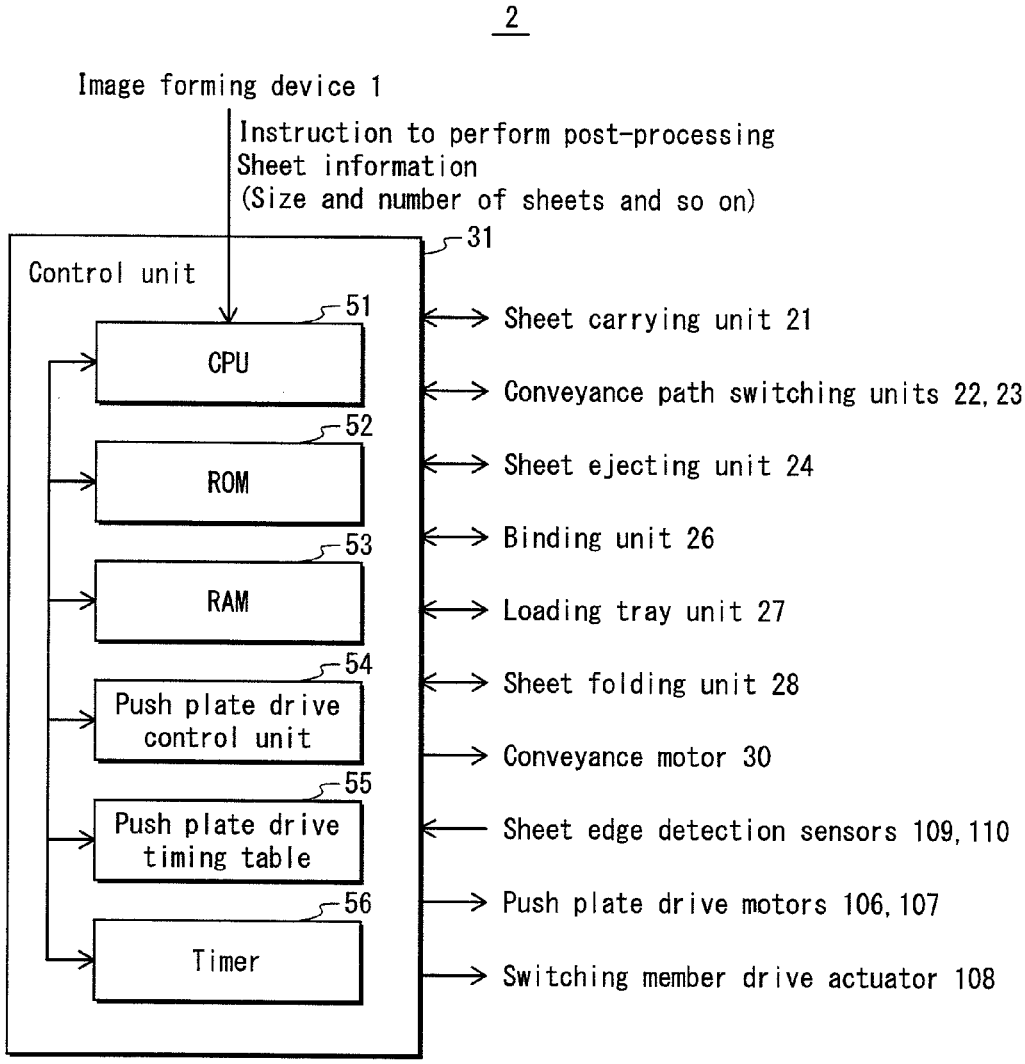
FIG. 4 is a block diagram showing a configuration of a control unit included in the sheet post-processing device.

FIG. 4 is a block diagram showing a configuration of the control unit 31.

As shown in FIG. 4, the control unit 31 includes, as its main components, a CPU 51, a ROM 52, a RAM 53, a push plate drive control unit 54, a push plate drive timing table 55, and a timer 56. These components are configured to communicate with one another.

Upon receiving, from the image forming device 1, an instruction to perform the post-processing function including the stapling function and the sheet folding function, and sheet information including sizes, the number, and types of sheets on which post-processing is to be performed, the CPU 51 controls each component such as the binding unit 26 and the sheet folding unit 28 based on the received sheet information to cause each component to perform the post-processing instructed from the image forming device 1 smoothly.

The ROM 52 stores therein a program relating to the post-processing. The RAM 53 is a work area of the CPU 51.

The push plate drive control unit 54 controls the push plate drive motors 106 and 107 to cause the push plates 103 and 104 to perform the sheet pushing operation. In the present embodiment, the control is performed so that the pushing operation is performed in a state where tension in the conveyance direction is applied to a sheet being conveyed.

(4) Explanation of Control Over Pushing Operation

FIGS. 5A through 5F are schematic diagrams for explaining control over a sheet pushing operation, and each show a configuration obtained by rotating the configuration shown in FIG. 3 approximately 90 degrees in a counterclockwise direction. In each of FIGS. 5A through 5F, only the conveyance roller pair 101, the folding roller pair 102, the push plate 103, and the sheet edge detection sensor 109 are illustrated as members necessary for explanation of the pushing operation performed by the push plate 103.

FIG. 5A illustrates the operation at time t0 when a front edge of the sheet S (sheet edge) reaches a detection position β where the sheet edge detection sensor 109 detects the sheet edge while the sheet S is being conveyed along the conveyance path Pa by the conveyance roller pair 101 in the sheet conveyance direction at a (constant) sheet conveyance speed Vs.

At time t0, although the folding roller pair 102 is rotated, the push plate 103 stops operating at the standby position.

A position α on the sheet S shown by a triangle is a target fold position. In this embodiment, the position α is a target fold position when the sheet S is folded in two (a position where the sheet S is bisected in the sheet conveyance direction). A distance L is a distance from the sheet edge to the target fold position α, and has been determined in advance for each sheet size. For example, the distance L is 210 mm when an A3 sheet is conveyed in a lengthwise direction (a direction in which a longer side of the sheet is parallel to the sheet conveyance direction and a shorter side of the sheet is perpendicular to the sheet conveyance direction), and is 182 mm when a B4 sheet is conveyed in the lengthwise direction.

FIG. 5B illustrates the operation at time t1 when a time period Ta elapses after the target fold position α on the sheet S passes through the detection position β where the sheet edge detection sensor 109 detects the sheet edge. At time t1, the push plate 103 is started moving.

A speed at which the push plate 103 is moved (push plate movement speed Vf) is constant. In this embodiment, the push plate movement speed Vf is set to be 1.2 times faster than the sheet conveyance speed Vs. A distance La shown in FIG. 5B is a distance from a position on the sheet S directly under the push plate 103 to the target fold position α in the sheet conveyance direction.

The time period Ta is a time period required for the target fold position α on the sheet S to reach a position the distance La downstream from the position directly under the push plate 103 in the sheet conveyance direction after the target fold position α passes through the detection position β where the sheet edge detection sensor 109 detects the sheet edge.

The time t1 is a time point at which a time period obtained by adding the time period Ta to a time period (L/Vs) elapses after the time t0. The time t1 is measured by the timer 56, and is determined in advance as a time at which the sheet S is drawn into the nip N1 of the folding roller pair 102 first at the target fold position α, as described later.

FIG. 5C illustrates the operation at time t2 when the edge of the push plate 103 first comes into contact with the sheet S. At time t2, the target fold position α on the sheet S is located a distance Lb downstream from a position where the push plate 103 is in contact with the sheet S in the sheet conveyance direction.

A portion P shown in FIG. 5C is a surface portion of the sheet S between a position S1 where the edge of the push plate 103 is in contact with the sheet S and a position S2 where the sheet S is sandwiched between the conveyance roller pair 101. Hereinafter, the portion P is referred to as a first portion P.

The push plate 103 starts performing the pushing operation to push the sheet S into the nip N1 of the folding roller pair 102 at time t2. Since the push plate movement speed Vf is 1.2 times faster than the sheet conveyance speed Vs as described above, a distance that the push plate 103 is moved downward so as to be perpendicular to the conveyance path Pa per unit time is longer than a distance that the sheet S is conveyed along the conveyance path Pa per unit time.

Therefore, the push plate 103 is moved downward with the edge thereof sliding on the sheet S in a direction toward the sheet edge while being in contact with the sheet S at a speed higher by a relative speed difference than a speed at which the sheet S is conveyed. By the edge of the push plate 103 sliding on the sheet S, friction is caused between the edge of the push plate 103 and the sheet S. The friction applies tension to the first portion P in the sheet conveyance direction (strains the first portion P). The pushing operation is performed in the state where the tension is applied to the first portion P.

FIG. 5D illustrates a state of the sheet S in the midst of the pushing operation. FIG. 5D illustrates a state of the sheet S at time t3 before the position S1 on the sheet S reaches the nip N1 of the folding roller pair 102. At time t3, the sheet S sags downward at the position S1. Due to the speed difference defined as Vf>Vs, as the push plate 103 pushes the sheet S, in a state where tension is applied to the first portion P, a second portion Q of the sheet S located further downstream than the position where the push plate 103 is currently in contact with the sheet S (a portion in the side of the sheet edge) in the sheet conveyance direction is drawn back in a direction opposite to the sheet conveyance direction and the target fold position α moves toward the nip N1 of the folding roller pair 102.

Such a state continues from time the edge of the push plate 103 first comes into contact with the sheet S until the sheet S is drawn into the nip N1 of the folding roller pair 102 at the target fold position α.

FIG. 5E illustrates the operation at time t4 when the sheet S is drawn into the nip N1 of the folding roller pair 102 first at the target fold position α.

At time t4, the position S1 coincides with the target fold position α on the sheet S. With this configuration, the sheet S is folded in two at the target fold position α, and conveyed downward from the folded portion thereof while being sandwiched between the folding roller pair 102.

The push plate 103 is moved backward to be returned to the standby position once it is moved to a position where the sheet S is drawn into the nip N1 of the roller pair 102 at the target fold position α.

FIG. 5F illustrates the operation at time t5 when the folded portion of the sheet S passes through the nip N1 of the folding roller pair 102. At time t5 and thereafter, the sheet S folded in two is further conveyed by the folding roller pair 102.

By starting the pushing operation performed by the push plate 103 at a timing set so that the sheet S is drawn into the nip N1 of the folding roller pair 102 first at the target folding position α, i.e. at time t1 in the above-mentioned example, the sheet S is folded at the target fold position α while the sheet S is being conveyed.

FIGS. 6A through 6D are schematic diagrams illustrating, as a comparative example, a folding operation when a push plate movement speed Vfl is slower than the sheet conveyance speed Vs.

Figure 6A:
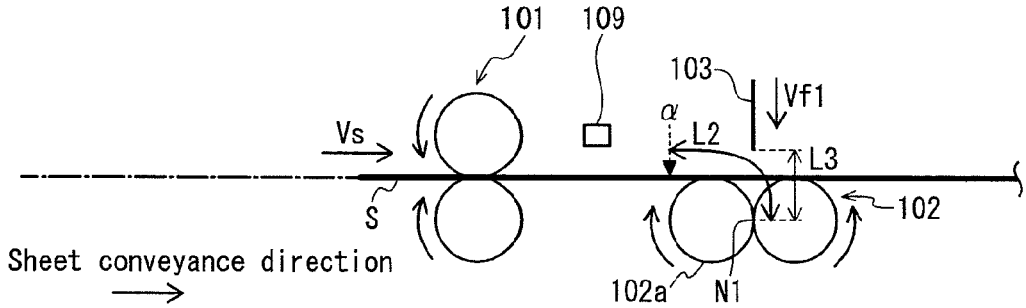
FIGS. 6A through 6D are schematic diagrams illustrating a folding operation as a comparative example.

FIG. 6A shows the operation when the push plate 103 is started moving toward the sheet S. It can be seen from FIG. 6A that the target fold position α on the sheet S is located further upstream than the push plate 103 in the sheet conveyance direction at this time, in contrast to the configuration shown in FIG. 5B described above.

The reason why the target fold position α is located further upstream than the push plate 103 in the sheet conveyance direction is as follows: since the push plate movement speed Vfl is slower than the sheet conveyance speed Vs in this comparative example, it is necessary that a distance L2 along a circumference of the folding roller 102*a* from the target fold position α to the nip N1 of the folding roller pair 102 be longer than a stroke L3 of the push plate 103 according to the speed difference at the time of FIG. 6A.

Figure 6B:
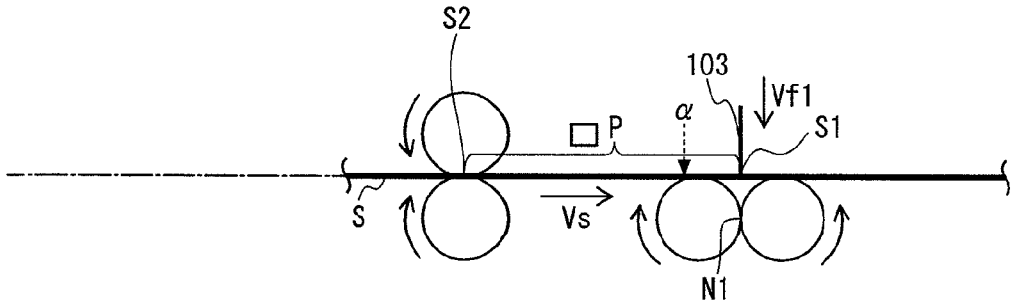

FIG. 6B illustrates the operation when the edge of the push plate 103 comes into contact with the sheet S. It can be seen from FIG. 6B that, at this time, the target fold position α comes closer to the nip N1 than that in a case shown in FIG. 6A. Once the edge of the push plate 103 comes into contact with the sheet S, friction is caused between the push plate 103 and the sheet S. Since a relation Vfl<Vs is satisfied, the friction applies force in a direction opposite to the sheet conveyance direction, which is braking force, to the position S1 where the push plate 103 is in contact with the sheet S. As a result, force to deflect the sheet S rather than tensile force is applied to the first portion P of the sheet S.

Figure 6C:
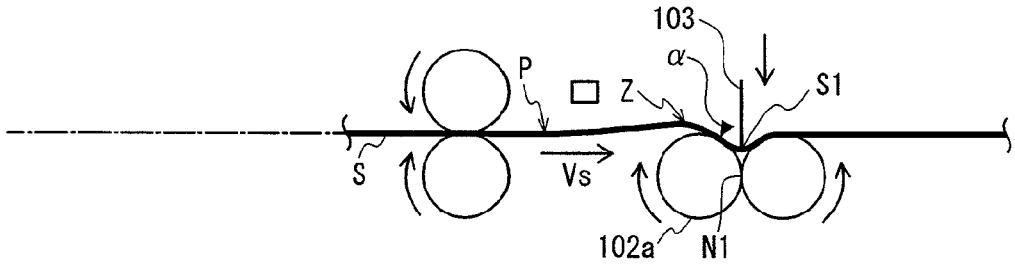

FIG. 6C illustrates the operation when deflection Z occurs in the first portion P of the sheet S.

As illustrated in FIG. 6C, when the deflection Z occurs on the sheet S, a delay occurs in movement of the target fold position α according to the amount of defection, compared to a case where the deflection does not occur on the sheet S. The amount of deflection varies depending on the degree of friction applied between the push plate 103 and the sheet S. Since the degree of friction is likely to vary depending on surface roughness of each sheet, the amount of deflection varies within a certain range.

If the amount of deflection differs for each sheet, the amount of delay in movement of the target fold position α varies accordingly. This makes an actual fold position more likely to vary.

Figure 6D:
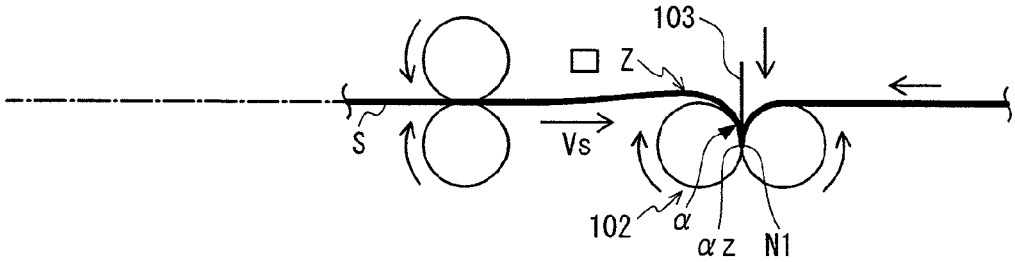

FIG. 6D illustrates the folding operation performed in a state where the deflection Z occurs. The sheet S is drawn into the nip N1 of the folding roller pair 102 at a position αz, which is closer to the sheet edge than the target fold position α is. It can be seen from FIG. 6D that an actual fold position does not coincide with the target fold position α.

If the actual fold position varies as described above, positioning accuracy reduces. For example, some sheets are folded at the target fold position α while others are folded at a position different from the target fold position α.

In contrast, in the present embodiment, the pushing operation is performed by the push plate 103 in a state where tension is applied to the first portion P of the sheet S in the sheet conveyance direction as described above. The fold position is therefore less likely to vary as deflection is less likely to occur on the first portion P of the sheet S, and the sheet S is drawn into the folding roller pair 102 at the target fold position α in a state where the first portion P is strained. Accordingly, it is possible to prevent the fold position from varying and to improve positioning accuracy.

Which portion of the sheet S being conveyed is drawn into the folding roller pair 102 varies depending on a timing at which the push plate 103 is started moving. Therefore, by setting a timing at which the push plate 103 is started moving in a timely manner, the sheet S is drawn into the folding roller pair 102 at the target fold position α.

In the present embodiment, the push plate movement speed Vf relative to the sheet conveyance speed Vs and a timing at which the push plate 103 is started moving are determined in advance by experiments and simulations considering a time from the start of the movement of the push plate 103 until the push plate 103 is moved at a given movement speed Vf and the sliding amount when the edge of the push plate 103 slides on the sheet S in a state where the edge of the push plate 103 is in contact with the sheet S, so that, in a state where tension is applied to the first portion P of the sheet S, the second portion Q is drawn back in a direction opposite to the sheet conveyance direction and the sheet S is drawn into the nip N1 of the folding roller pair 102 first at the target fold position α. Information indicating the determined timing at which the push plate 103 is started moving is then stored in the push plate drive timing table 55.

FIG. 7 shows an example of the push plate drive timing table 55. The push plate drive timing table 55 is included in a non-volatile storage unit (not illustrated).

As shown in FIG. 7, timing information indicating a drive start timing for each sheet size is written in the push plate drive timing table 55.

The drive start timing corresponds to the time t1 shown in FIG. 5B. For example, the drive start timing for an A3 sheet is a timing T1, and the drive start timing for a B4 sheet is a timing T2.

When the sheet S is bisected and folded in two, the distance L (FIG. 5A) from the sheet edge to the target fold position α varies depending on the sheet size. When a material for the sheet S is the same for each sheet size, the sliding amount when the edge of the push plate 103 slides on the sheet S in a state where the edge of the push plate 103 is in contact with the sheet S is the same for each sheet size in most cases.

In view of the above, the drive start timing to start driving the push plate 103 can be defined for each sheet size as a time at which a time period obtained by adding the time period Ta to a time period (Ls/Vs) elapses after the time t0 by setting, for each size, the distance La (a distance from a position on the sheet S corresponding to the push plate 103 to the target fold position α) shown in FIG. 5B to the same value and the time period Ta to the same time period, and setting the distance L to a distance Ls determined for each sheet size.

(5) Processing to Control Pushing Operation

Figure 8:
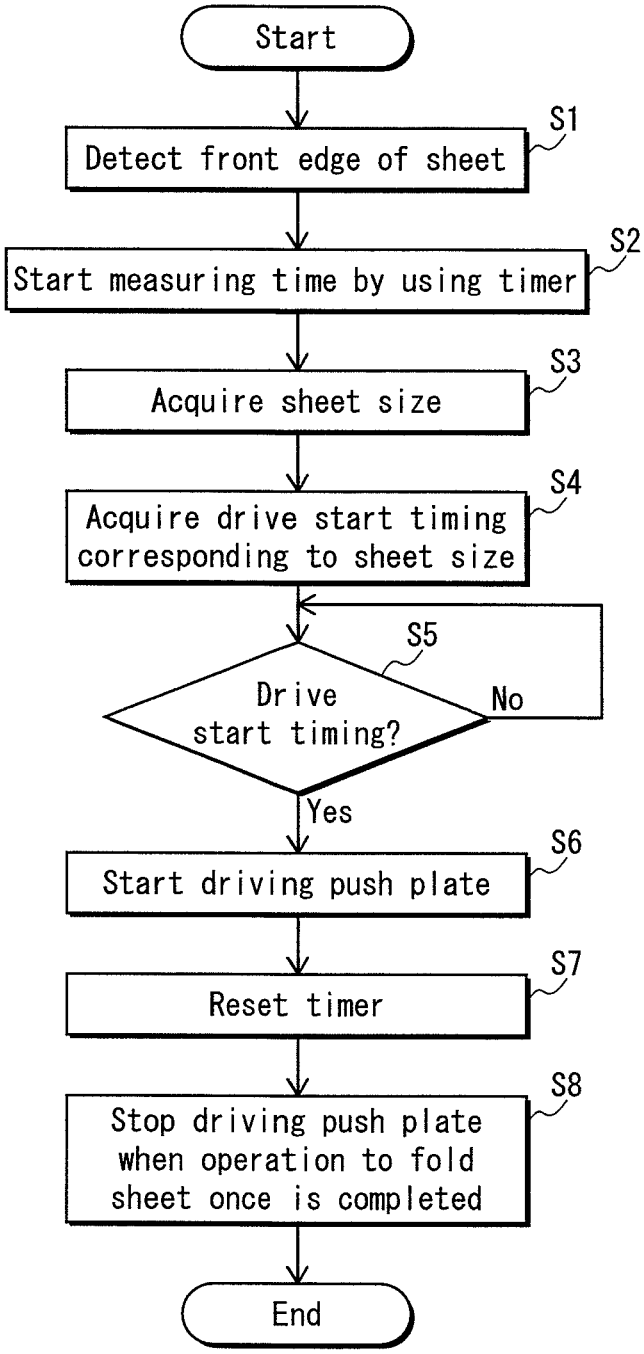
FIG. 8 is a flow chart showing processing to control a pushing operation performed by the control unit.

FIG. 8 is a flow chart showing processing to control the pushing operation performed by the control unit 31 when a sheet is folded in two.

As shown in FIG. 8, when the sheet edge detection sensor 109 detects a front edge of the sheet S being conveyed along the conveyance path Pa by the conveyance roller pair 101 (at time t0 in FIG. 5A) (step S1), the timer 56 starts measuring a time (step S2).

A size of the sheet S being conveyed is acquired (step S3) by receiving the sheet information from the image forming device 1.

A drive start timing to start driving the push plate 103 corresponding to the acquired size is acquired (step S4) by reading the timing information written in the push plate drive timing table 55.

Whether or not a timing is the drive start timing is judged based on a count value measured by the timer 56 (step S5) by judging whether or not the count value has reached the acquired drive start timing.

When the timing is judged to be the drive start timing (YES in step S5), the push plate 103 is started driving (at time t1 in FIG. 5B) (step S6), and the timer 56 is reset (step S7).

The push plate 103 is started driving by starting driving the push plate drive motor 106. In response to this, the push plate 103 is moved from the standby position (the position shown by the solid line in FIG. 3) to perform the pushing operation (at time t1 to t5 shown in FIGS. 5B to 5F).

When the push plate 103 is moved backward to the standby position after the operation to fold the sheet once is completed, the push plate 103 is stopped driving (step S8) and processing is completed. When a front edge of a next sheet S is detected, processing in the steps S1 to S8 is performed again. Each time a sheet S is conveyed, the processing in the steps S1 to S8 is performed for the conveyed sheet S.

Although control processing performed when the sheet S is folded in two is described above, similar control processing is performed when the sheet S is folded in three. This means that the drive start timing to start driving the push plate 103 is set so that the target fold position is the position α1 (FIG. 2B) when the push plate 103 performs the pushing operation, and the drive start timing to start driving the push plate 104 is set so that the target fold position is the position α2 (FIG. 2B) when the push plate 104 performs the pushing operation. Since a distance from a sheet edge to the target fold position α1 or α2 varies depending on a sheet size, the drive start timing may be determined in advance according to the target fold position on the sheet S, similarly to a case where the sheet S is folded in two.

As described above, the push plate 103 performs the pushing operation at a timing preset according to the target fold position so that, in a state where tension is applied in the sheet conveyance direction to the first portion P of the sheet S being conveyed, the second portion Q is drawn back in a direction opposite to the sheet conveyance direction and the sheet S is drawn into the nip N1 of the folding roller pair 102 first at the target fold position α. With this configuration, the sheet S is folded at the target fold position α with accuracy while the sheet S is being conveyed, without a stopper as provided in the conventional device.

The present invention is not limited to the sheet post-processing device, and may be a sheet folding method. Alternatively, the present invention may be a program for causing a computer to implement the method. The program according to the present invention may be recorded on a computer-readable recording medium such as a magnetic disc including a magnetic tape and a flexible disk, and an optical recording medium including a DVD-ROM, a DVD-RAM, a CD-ROM, a CD-R, an MO, and a PD. The program may be produced and transferred by being recorded on such a recording medium, and the program itself may be transmitted and supplied via a wired or wireless network including the Internet, broadcasts, an electric telecommunication line, satellite communications and the like.

(Modifications)

Although the present invention has been described based on the above-mentioned embodiment, it is obvious that the present invention is not limited to the above-mentioned embodiment. The following modifications also fall within a scope of the present invention.

(1) In the above-mentioned embodiment, when the sheet S is folded in two, the target fold position α is a position in the middle of the sheet S in the sheet conveyance direction. The target fold position α, however, is not limited to the position in the middle of the sheet S in the sheet conveyance direction, and may be another position according to how to fold the sheet S in two. The drive start timing to start driving the push plate 103 is set according to the target fold position. The same applies to a case where the sheet S is folded in three. The target fold positions α1 and α2 are not limited to the positions where the sheet S is approximately trisected, and may be different positions.

(2) In the above-mentioned embodiment, the push plate movement speed Vf is constant regardless of the sheet size and the sheet type. The push plate movement speed Vf, however, may not be constant.

For example, the push plate movement speed Vf may vary depending on the sheet type. Included sheet types are a glossy paper having been treated so as to be glossier than a normal paper, a paper having a different surface roughness than a normal paper including a groundwood paper, and a paper made of a different material than a normal paper including a tracing paper.

Since a glossy paper is slipperier than a commonly used plain paper when the edge of the push plate 103 comes into contact with the glossy paper, friction caused between the edge of the push plate 103 and the glossy paper is less than that caused between the edge of the push plate 103 and the plain paper and thus tension applied to the first portion P is less than that applied when the plain paper is used. In order to perform the pushing operation in a state where tension is applied to the first portion P, a push plate movement speed Vfa at which the push plate is moved toward a glossy paper may be set to be a little faster than the push plate movement speed Vf at which the push plate is moved toward a plain paper.

When a glossy paper is used, if the movement speed at which the push plate 103 is moved toward the glossy paper is set to be faster than the movement speed at which the push plate 103 is moved toward a plain paper without changing the sheet conveyance speed and the target fold position, a timing at which the push plate 103 performs the pushing operation delays compared to a case where a plain paper is used according to the speed difference.

In contrast, when a groundwood paper is used, friction caused between the edge of the push plate 103 and the groundwood paper is more than that caused between the edge of the push plate 103 and the plain paper, and thus tension applied to the first portion P is more than that applied when the plain paper is used. In this case, a push plate movement speed Vfb at which the push plate is moved toward a groundwood paper may be set to be a little slower than the push plate movement speed Vf at which the push plate is moved toward a plain paper. When a groundwood paper is used, if the movement speed at which the push plate 103 is moved toward the groundwood paper is set to be slower than the movement speed at which the push plate 103 is moved toward a plain paper without changing the sheet conveyance speed and the target fold position, a timing at which the push plate 103 performs the pushing operation becomes earlier compared to a case where the plain paper is used. As described above, a timing at which the pushing operation is performed may vary depending on the sheet type.

In order for the push plate 103 to perform the pushing operation in a state where tension is applied to the first portion P in the sheet conveyance direction, of course, the movement speed at which the push plate 103 is moved relative to the sheet conveyance speed can be determined by an experiment and the like so as to be suitable within a range in which the tension is applied.

In a case where both the sheet conveyance speed and the push plate movement speed vary depending on the sheet type, a suitable timing is determined based on both the sheet conveyance speed and the push plate movement speed. The same applies to a case where a sheet is folded in three.

(3) In the above-mentioned embodiment, the push plate movement speed Vf is set to be 1.2 times faster than the sheet conveyance speed Vs. The ratio of the push plate movement speed Vf to the sheet conveyance speed Vs is not limited to this ratio, and may be set according to the configuration of the device so that tension is applied to the first portion P of the sheet S in the sheet conveyance direction.

In this above-mentioned embodiment, the deflection Z occurring in the first portion P is described to reduce the positioning accuracy, with reference FIG. 6. If the degree of the deflection Z is kept to a minimum, however, the positioning accuracy can be within a tolerance. In this case, the push plate movement speed Vf may be slower than the above-mentioned speed, and a timing at which the pushing operation is performed may be preset according to the movement speed.

(4) In the above-mentioned embodiment, a size of the sheet S being conveyed is acquired from the image forming device 1. The method of acquiring the size of the sheet S, however, is not limited to the above-mentioned method. For example, the sheet post-processing device 2 may include an operating unit that receives an input of a sheet size from a user, and the sheet size may be acquired via the operating unit. Although the sheet post-processing device is described to have the configuration in which the folding operation can be performed for the sheets S having different sizes, the configuration of the sheet post-processing device is not limited to this configuration. The present invention is applicable to a sheet post-processing device that can switch, for each sheet having the same size, whether to fold the sheet in two or in three.

(5) Described in the above-mentioned embodiment is an example in which the sheet post-processing device according to the present invention is applied to a device that folds a sheet output from a multiple function peripheral (MFP) as one example of an image forming device. The sheet post-processing device according to the present invention, however, is applicable to other types of devices. For example, the sheet post-processing device according to the present invention may be applied to a sheet post-processing device that folds a sheet output from an image forming device such as a copier, a printer, and a facsimile machine.

Although the push plates 103 and 104 are used as a push member that pushes a sheet into the nip N1 of the folding roller pair 102, the push member is not limited to a plate-like member. For example, an extra-fine linear member may be used as the push member.

Furthermore, although the push plate 103 is described to be moved backward when the target fold position α on the sheet moves to a position at which the sheet is first drawn into the nip of the folding roller pair 102, the configuration of the push plate 103, however, is not limited to this. For example, the movement of the push plate 103 may be continued after the edge of the push plate 103 is drawn into the nip N1 along with the sheet, and the push plate 103 may be moved backward when the edge of the push plate 103 is moved to a central position of the nip N1 in a rotation direction of the rollers. The same applies to the push plate 104.

The detection position β where the sheet edge detection sensor 109 detects the sheet edge is described to be located further downstream, in the sheet conveyance direction, than the conveyance roller pair 101 disposed on the conveyance path Pa and be located further upstream, in the sheet conveyance direction, than a position where a track of movement of the push plate 103 and the conveyance path Pa cross (a position J shown in FIG. 3). The detection position β, however, is not limited to the above-mentioned position. The detection position β may be located further downstream than the position J in the sheet conveyance direction as long as the sheet edge is detectable.

Furthermore, the sheet edge detection sensor 109 may not detect the sheet edge. The sheet edge detection sensor 109 may detect a tail edge of the sheet as long as the sheet is drawn into the nip N1 of the folding roller pair 102 first at the target fold position α when the push plate 103 starts performing the pushing operation after a predetermined time period elapses after the detection of the sheet. In this case, a detection position where the tail edge of the sheet is detected is located further upstream, in the sheet conveyance direction, than the detection position β described in the above-mentioned embodiment. The same applies to the sheet detection position and the sheet detection method pertaining to the sheet edge detection sensor 110.

In the above-mentioned embodiment, the conveyance roller pair 101 and the folding roller pair 102 are respectively used as the first rotating body pair for conveying the sheet and the second rotating body pair for folding the sheet. The configuration of the rotating body pairs, however, is not limited to that described in the above-mentioned embodiment. For example, a belt-like member may be used as a rotating body constituting each rotating body pair.

Furthermore, the above-mentioned embodiment and the above-mentioned modifications may be combined with one another.

<Summary>

The above-mentioned embodiment and the above-mentioned modifications show one aspect of the present invention to solve the problems presented in the RELATED ART section. The above-mentioned embodiment and the above-mentioned modifications are summarized as follows:

One aspect of the present invention is a sheet post-processing device that folds a sheet output from an image forming device at a predetermined target fold position, comprising: a first rotating body pair configured to convey the sheet; a second rotating body pair disposed along a sheet conveyance path and further downstream than the first rotating body pair in a sheet conveyance direction; a push unit configured to move a push member in a direction transverse to the sheet conveyance path so that, while the sheet is being conveyed, the push member comes into contact with the sheet and pushes the sheet into a nip of the second rotating body pair, the push member being disposed opposite the second rotating body pair across the sheet conveyance path; and a control unit configured to control the push unit so that the pushing operation of the push member is performed at a timing preset according to the target fold position;

In the above-mentioned sheet post-processing device, a movement speed at which the push member is moved during the pushing operation may be set to be faster than a conveyance speed at which the first rotating body pair conveys the sheet, and the timing may be preset so that: the pushing operation is initiated such that, when the push member comes into contact with the sheet, the target fold position is located a predetermined distance downstream, in the sheet conveyance direction, from a contact position where the push member is in contact with the sheet; and due to a difference between the movement speed and the conveyance speed, as the push member pushes the sheet, a portion of the sheet located further downstream than the contact position in the sheet conveyance direction is drawn back in a direction opposite to the sheet conveyance direction and the sheet is drawn into the nip of the second rotating body pair first at the target fold position;

In the above-mentioned sheet post-processing device, the movement speed may vary depending on a type of the sheet, and the timing may vary depending on the movement speed;

In the above-mentioned sheet post-processing device, when a part of the push member that is in contact with the sheet moves to a position of the nip of the second rotating body pair, the push member may be moved backward;

In the above-mentioned sheet post-processing device, the sheet conveyance path may include a path part that is located further downstream, in the sheet conveyance direction, than a cross position where the sheet conveyance path and a track of movement of the push member cross and extends away from an imaginary plane in a direction opposite to the direction in which the push member is moved as the path part extends downstream in the sheet conveyance direction, the imaginary plane being perpendicular to the direction in which the push member is moved and passing through the cross position;

The above-mentioned sheet post-processing device may further comprise a detection unit configured to detect the sheet being conveyed along the sheet conveyance path, wherein the timing may be a timing at which a predetermined time period set according to the target fold position elapses after the detection unit detects the sheet;

Another aspect of the present invention is a sheet folding method for use in a sheet post-processing device that folds a sheet output from an image forming device at a predetermined target fold position, the sheet folding method comprising: a first step of conveying the sheet using a first rotating body pair; and a second step of moving a push member in a direction transverse to a sheet conveyance path so that, while the sheet is being conveyed, the push member comes into contact with the sheet and pushes the sheet into a nip of a second rotating body pair at a timing preset according to the target fold position, the second rotating body pair being disposed along the sheet conveyance path and further downstream than the first rotating body pair in a sheet conveyance direction, the push member being disposed opposite the second rotating body pair across the sheet conveyance path;

In the above-mentioned sheet folding method, a movement speed at which the push member is moved during the pushing operation may be set to be faster than a conveyance speed at which the first rotating body pair conveys the sheet, and the timing may be preset so that: the pushing operation is initiated such that, when the push member comes into contact with the sheet, the target fold position is located a predetermined distance downstream, in the sheet conveyance direction, from a contact position where the push member is in contact with the sheet; and due to a difference between the movement speed and the conveyance speed, as the push member pushes the sheet, a portion of the sheet located further downstream than the contact position in the sheet conveyance direction is drawn back in a direction opposite to the sheet conveyance direction and the sheet is drawn into the nip of the second rotating body pair first at the target fold position;

In the above-mentioned sheet folding method, the movement speed may vary depending on a type of the sheet, and the timing may vary depending on the movement speed;

In the above-mentioned sheet folding method, when a part of the push member that is in contact with the sheet moves to a position of the nip of the second rotating body pair, the push member may be moved backward;

In the above-mentioned sheet folding method, the sheet conveyance path may include a path part that is located further downstream, in the sheet conveyance direction, than a cross position where the sheet conveyance path and a track of movement of the push member cross and extends away from an imaginary plane in a direction opposite to the direction in which the push member is moved as the path part extends downstream in the sheet conveyance direction, the imaginary plane being perpendicular to the direction in which the push member is moved and passing through the cross position; and The above-mentioned sheet folding method may further comprise a third step of detecting the sheet being conveyed along the sheet conveyance path, wherein the timing may be a timing at which a predetermined time period set according to the target fold position elapses after the sheet is detected in the third step.

With the above-mentioned configuration, a sheet is folded at a target folding location while the sheet is being conveyed, without a stopper.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet post-processing device that folds a sheet output from an image forming device at a predetermined target fold position, the sheet post-processing device comprising:

a first rotating body pair configured to convey the sheet;

a second rotating body pair disposed along a sheet conveyance path and further downstream than the first rotating body pair in a sheet conveyance direction;

a push unit configured to move a push member in a direction transverse to the sheet conveyance path so that, while the sheet is being conveyed, the push member comes into contact with the sheet and pushes the sheet into a nip of the second rotating body pair, the push member being disposed opposite the second rotating body pair across the sheet conveyance path; and a control unit configured to control the push unit so that the pushing operation of the push member is performed at a timing preset according to the target fold position;

wherein:

a movement speed at which the push member is moved during the pushing operation is set to be faster than a conveyance speed at which the first rotating body pair conveys the sheet; and the timing is preset so that:

the pushing operation is initiated such that, when the push member comes into contact with the sheet, the target fold position is located a predetermined distance downstream, in the sheet conveyance direction, from a contact position where the push member is in contact with the sheet; and due to a difference between the movement speed and the conveyance speed, as the push member pushes the sheet, a portion of the sheet located further downstream than the contact position in the sheet conveyance direction is drawn back in a direction opposite to the sheet conveyance direction and the sheet is drawn into the nip of the second rotating body pair first at the target fold position.

2. The sheet post-processing device of claim 1, wherein the movement speed varies depending on a type of the sheet, and the timing varies depending on the movement speed.

3. The sheet post-processing device of claim 1, wherein when a part of the push member that is in contact with the sheet moves to a position of the nip of the second rotating body pair, the push member is moved backward.

4. The sheet post-processing device of claim 1, wherein the sheet conveyance path includes a path part that is located further downstream, in the sheet conveyance direction, than a cross position where the sheet conveyance path and a track of movement of the push member cross and extends away from an imaginary plane in a direction opposite to the direction in which the push member is moved as the path part extends downstream in the sheet conveyance direction, the imaginary plane being perpendicular to the direction in which the push member is moved and passing through the cross position.

5. The sheet post-processing device of claim 1 further comprising a detection unit configured to detect the sheet being conveyed along the sheet conveyance path, wherein the timing is a timing at which a predetermined time period set according to the target fold position elapses after the detection unit detects the sheet.

6. A sheet folding method for use in a sheet post-processing device that folds a sheet output from an image forming device at a predetermined target fold position, the sheet folding method comprising:

conveying the sheet using a first rotating body pair; and moving a push member in a direction transverse to a sheet conveyance path so that, while the sheet is being conveyed, the push member comes into contact with the sheet and pushes the sheet into a nip of a second rotating body pair at a timing preset according to the target fold position, the second rotating body pair being disposed along the sheet conveyance path and further downstream than the first rotating body pair in a sheet conveyance direction, and the push member being disposed opposite the second rotating body pair across the sheet conveyance path;

wherein:

a movement speed at which the push member is moved during the pushing operation is set to be faster than a conveyance speed at which the first rotating body pair conveys the sheet; and the timing is preset so that:

the pushing operation is initiated such that, when the push member comes into contact with the sheet, the target fold position is located a predetermined distance downstream, in the sheet conveyance direction, from a contact position where the push member is in contact with the sheet; and due to a difference between the movement speed and the conveyance speed, as the push member pushes the sheet, a portion of the sheet located further downstream than the contact position in the sheet conveyance direction is drawn back in a direction opposite to the sheet conveyance direction and the sheet is drawn into the nip of the second rotating body pair first at the target fold position.

7. The sheet folding method of claim 6, wherein the movement speed varies depending on a type of the sheet, and the timing varies depending on the movement speed.

8. The sheet folding method of claim 6, wherein when a part of the push member that is in contact with the sheet moves to a position of the nip of the second rotating body pair, the push member is moved backward.

9. The sheet folding method of claim 6, wherein the sheet conveyance path includes a path part that is located further downstream, in the sheet conveyance direction, than a cross position where the sheet conveyance path and a track of movement of the push member cross and extends away from an imaginary plane in a direction opposite to the direction in which the push member is moved as the path part extends downstream in the sheet conveyance direction, the imaginary plane being perpendicular to the direction in which the push member is moved and passing through the cross position.

10. The sheet folding method of claim 6, further comprising detecting the sheet being conveyed along the sheet conveyance path, wherein the timing is a timing at which a predetermined time period set according to the target fold position elapses after the sheet is detected.

* * * * *